US005404262A

United States Patent [19]

Enomoto et al.

[11] Patent Number: 5,404,262

[45] Date of Patent: Apr. 4, 1995

[54] APPARATUS FOR DRIVING ELECTROMAGNETIC ACTUATOR

[75] Inventors: Takashi Enomoto, Zama; Takashi Kunimi, Tokyo, both of Japan

[73] Assignee: Nihon Inter Electronics Corporation, Kanagawa, Japan

[21] Appl. No.: 986,466

[22] Filed: Dec. 4, 1992

[51] Int. Cl.[6] ..... H01H 47/00

[52] U.S. Cl. ..... 361/152; 361/186

[58] Field of Search ..... 361/139, 143, 152, 153, 361/160, 166, 170, 186

[56] References Cited

U.S. PATENT DOCUMENTS 4,661,766 4/1987 Hoffman et al. ..... 361/160

5,029,040 7/1991 Ito et al. ..... 361/187

5,053,911 10/1991 Kopec et al. ..... 361/154

5,175,663 12/1992 Iwabuchi et al. ..... 361/152

*Primary Examiner*—Jeffrey A. Gaffin

*Attorney, Agent, or Firm*—Meltzer, Lippe, Goldstein, Wolf, Schlissel & Sazer

[57] ABSTRACT

A counter electromotive force due to electromagnetic induction is generated on interruption of a current if an actuator 10 is in a normal state. An output signal generated by the counter electromotive force and a pulse signal which is generated from the fall of an input signal applied to the electronic switch are applied to an AND logical circuit 90 to determine whether or not the actuator is defective.

3 Claims, 7 Drawing Sheets

APPARATUS FOR DRIVING ELECTROMAGNETIC ACTUATOR

BACKGROUND OF THE INVENTION

1. Field of the Invention

The present invention relates to a drive apparatus in which an electronic switch is connected to excite an electromagnetic solenoid.

A term "ELECTROMAGNETIC ACTUATOR" used in the title is significant of an electromagnetic solenoid, electric motor, electromagnetic relay and other actuators using an electromagnetic force.

2. Description of Related Art

A conventional apparatus for driving an actuator is shown in, for example, FIGS. 5 to 7.

As shown in FIG. 5, when a pulse signal having such a narrow width that a solenoid MV is not actuated is applied to an electronic switch Q in a drive unit via a control input terminal IN of the apparatus, the electronic switch Q is turned on or off and the voltage Vz across the surge absorber Z has a wave-form which is in phase with that of the pulse signal Vi. The actuator drive apparatus is arranged in such a manner that the voltage Vz is divided by a voltage dividing circuit including resistor elements Rs and R so that a voltage VR having an appropriate level is inputted to an inverting amplifier A to output an output signal Vo.

The solenoid MV is represented by an equivalent circuit including a resistor and an inductor. If the solenoid of the apparatus is completely broken (failure mode B), no current flows through the solenoid of the apparatus. Accordingly, since the waveform of the output signal Vo is at a continuous high level as shown in FIG. 7, a defect of the solenoid MV is detected.

If the solenoid of the apparatus is partly-broken or burnt (failure mode A), the solenoid of the apparatus is conductive, although the solenoid exhibits no electromagnetic characteristics. Accordingly, the prior art actuator drive apparatus can not determine whether or not the solenoid MV is defective because the output signal Vo has a wave-form which is substantially the same as the normal wave-form as shown in FIG. 6.

SUMMARY OF THE INVENTION

It is therefore an object of the present invention to provide an actuator drive apparatus which can precisely determine whether or not a solenoid is defective to enhance the safety by using a characteristic in that a counter electromotive force due to electromagnetic induction occurs on interruption of a current if the solenoid is normal.

In an aspect of the present invention, there is provided an apparatus for driving a solenoid with which an electronic switch is connected, comprising a surge absorber which is connected with a connection between the solenoid and the electronic switch and is connected in parallel with the electronic switch, a resistive element which is connected between the surge absorber and ground, an amplifier for amplifying the voltage generated across the resistive element and having a gain which is changed in response to an input signal to the electronic switch, a gate circuit generating a pulse signal having a predetermined pulse width from the fall of the input signal applied to the electronic switch and an AND logical circuit for comparing the pulse signal from the gate circuit with the output signal from the amplifier.

In another aspect of the present invention, there is provided an apparatus for driving a solenoid with which an electronic switch is connected, comprising a surge absorber which is connected with a connection between the solenoid and the electronic switch and is connected in parallel with the electronic switch, a resistive element which is connected between the surge absorber and ground, an amplifier for amplifying the voltage generated across the resistive element and a check circuit for checking the output signal from the amplifier.

In a further aspect of the present invention, there is provided an apparatus for driving a solenoid with which an electronic switch is connected, comprising, a surge absorber which is connected with a connection between the solenoid and the electronic switch and is connected in parallel with the electronic switch, a resistive element which is connected between the surge absorber and ground and a check circuit for checking a voltage signal generated across the resistive element.

In order to examine whether the solenoid is operating normally when the solenoid is not actuated, it suffices to input to an electronic switch an input signal having a pulse width which is so narrow that the solenoid is not actuated.

When the input signal is inputted to the electronic switch, the solenoid generates a counter electromotive force due to electromangetic induction. The counter electromotive force is a high voltage. The majority of the induced voltage is absorbed in the absorber and the remainder of the voltage is applied to the resistor element.

The voltage generated across the resistor element is amplified by a pulse amplifier to provide an output signal having a high amplitude.

On the other hand, the gate circuit generates a pulse signal having a predetermined pulse width from the fall of the input signal applied to the electronic switch. The AND logical circuit compares the pulse signal from the gate circuit with the output signal from the pulse amplifier. It is determined that the solenoid is in a normal state, whenever the pulse signal output is obtained from the pulse amplifier.

If the input signal having a narrow width is inputted to the electronic switch when the solenoid is completely broken so that the actuator is defective (failure mode B), no counter electromotive force is generated in the solenoid. If the pulse signal from the gate circuit is inputted to the AND logical circuit while the output signal from the amplifier is not inputted to the AND logical circuit, no pulse signal is generated form the AND logical circuit. Therefore, it can be determined that the solenoid is in an abnormal state.

If the inputted signal having a narrow pulse width is applied to the electronic switch when the solenoid is partly broken or burnt (failure mode A), a low counter electromotive force is generated in the solenoid. The voltage generated across the resistor element by this counter electromotive force is amplified by the amplifier. An output signal from the amplifier which has a low pulse amplitude which does not reach a threshold level of the wave form shaper can't drive the AND logical circuit. In other words, even if the pulse signal from the gate circuit is applied to the AND logical circuit, no pulse signal is generated from the logical product circuit. It is thus determined that the solenoid is in an abnormal state.

Examination of the solenoid which is not actuated has been described above.

In order to examine whether or not the solenoid is normally operable when the solenoid is actuated, it is necessary only to momentarily interrupt the input signal applied to the electronic switch for such a period of time that the operation of the solenoid is not affected.

When the input signal to the electronic switch is momentarily interrupted, a high counter electromotive force is generated in the solenoid. A voltage generated across the resistor element due to counter electromotive force is amplified by an amplifier. Since the gain of the amplifier is lowered in response to the input signal, the amplitude of the output signal from the amplifier is suppressed to some extent and the output signal is applied to the AND logical circuit. The AND logical circuit compares the pulse signal from the gate circuit with the output signal from the amplifier to derive a pulse signal. It is determined from the output of the pulse signal that the solenoid is in a normal state.

If the input signal to the electronic switch is momentarily interrupted when the solenoid is partly-broken or burnt (failure mode A) while the solenoid is to be actuated, a counter electromotive force is generated in the solenoid. However the counter electromotive force is low since the electromagnetic induction is slight. The voltage which is generated across the resistor element by such a low counter electromotive force is amplified by the amplifier. Since the gain of the amplifier is lowered in response to the inputted signal, the output signal from the amplifier having a low amplitude is inputted to the AND logical circuit. In other words, no pulse signal is generated from the AND logical circuit even if the pulse from the gate circuit is input to the AND logical circuit. It is determined that the solenoid is in an abnormal state, whenever the pulse signal output is obtained from the pulse amplifier.

DESCRIPTION OF EMBODIMENTS

An embodiment of the present invention will be described with reference to the drawings.

Figure 1:
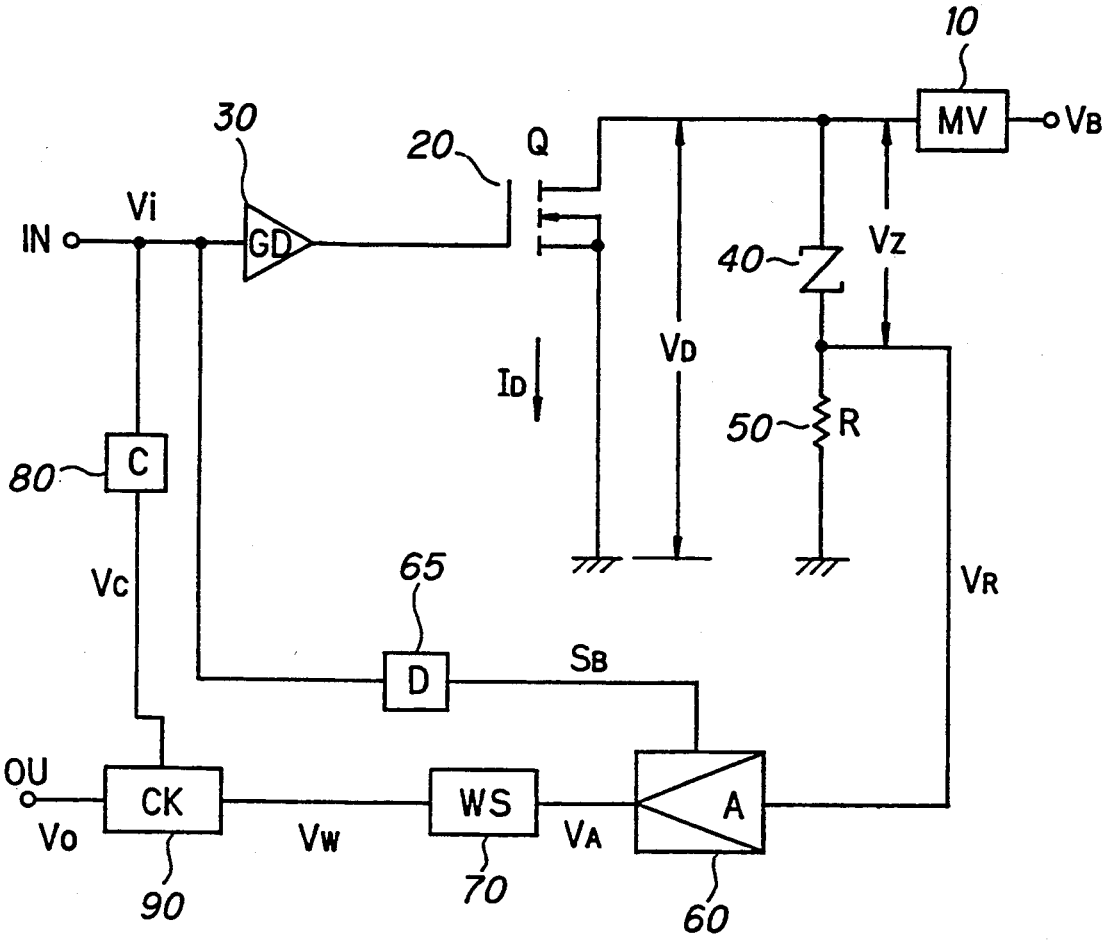
FIG. 1 is a schematic block diagram showing an embodiment of an actuator drive apparatus of the present invention.

Referring now to FIG. 1, an electromagnetic solenoid 10 which has a function of electromagnetic actuator is connected with a drive circuit 30 via an electronic switch 20 at one end thereof and is connected with a power supply VB at the other end thereof so that a voltage from the power supply VB is applied to a drain of the electronic switch 20 via the solenoid 10.

The solenoid 10 is provided to actuate a d.c. hydraulic, etc. and is represented by an equivalent circuit of a series circuit including an inductance L and a winding resistance r. The electronic switch 20 includes a MOSFET.

A Zener type surge absorber 40 is connected with a connection between the solenoid 10 and the electronic switch 20.

The surge absorber 40 is arranged in such a manner that it absorbs a voltage higher than a Zener voltage Vz, which is determined by the rating of the surge absorber 40, so as to protect the electronic switch 20, etc. which is connected in parallel with the surge absorber 40 when an electromotive force, which is a surge voltage generated on turning off of the solenoid 10, is applied.

A current detecting resistor 50 which is a resistive element is connected between the surge absorber 40 and ground.

The current detecting resistor 50 has a preset impedance which is considerably lower than the operating impedance of the surge absorber 50 for detecting the surge current. The pulse width of a pulse voltage VR generated thereacross is determined by a time constant determined by the solenoid 10 and the current detecting resistor 50.

The current detecting resistor 50 is connected with a variable gain amplifier 60 at one end thereof. The variable gain amplifier 60 amplifies a voltage generated across the current detecting resistor 50.

A smoothing circuit 65 is connected with the variable gain amplifier 60. The smoothing circuit 65 is arranged in such a manner that its output changes the gain of the amplifier. For example, the gain of the amplifier is lowered when the output of the smoothing circuit 65 is high.

A wave-form shaping circuit 70 is connected to the variable gain amplifier 60.

Figure 2:
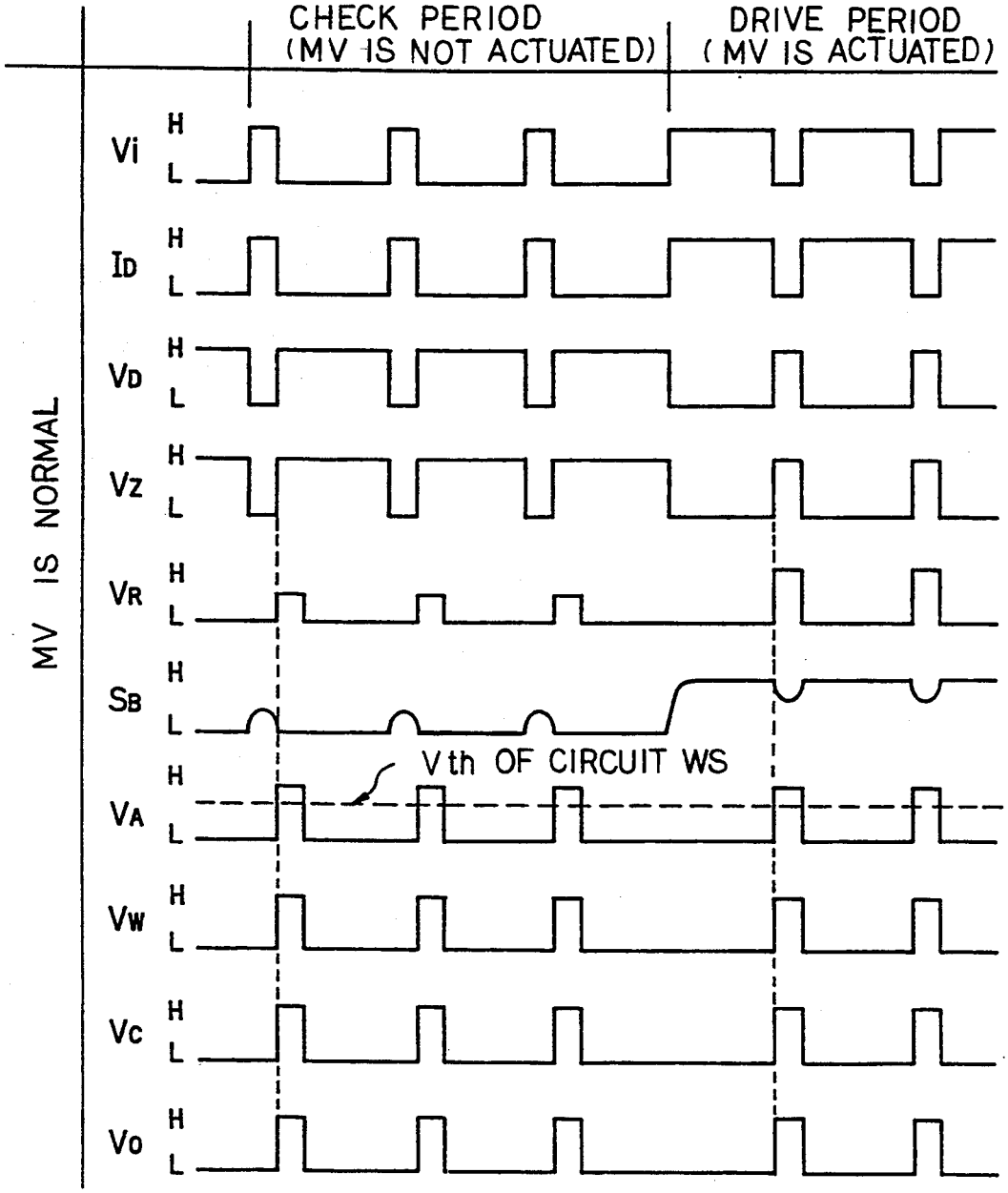
FIG. 2 is a timing chart when a solenoid is in a normal mode.
Figure 3:
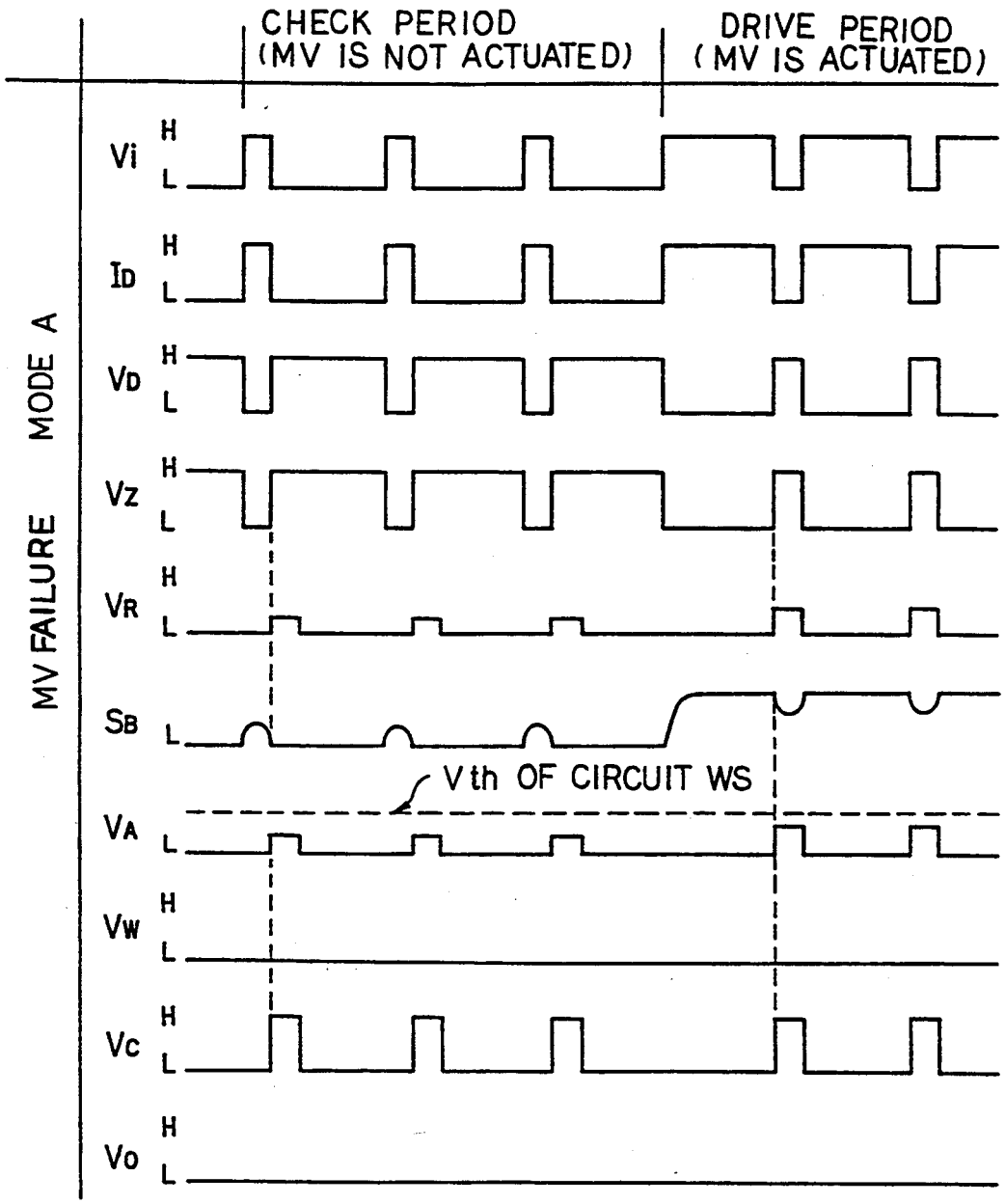
FIG. 3 is a timing chart when a solenoid is in failure mode A.

The wave-form shaping circuit 70 has a capability of shaping the output wave-form VA from the variable gain amplifier 60 and outputs a wave-form VW when VA is higher than a threshold value Vth as shown in FIG. 2 and does not output the wave-form when the output wave-form VA is lower than the threshold Vth as shown in FIG. 3.

The wave-form shaping circuit 70 is connected with an AND logical circuit 90.

A comparing gate signal generating circuit 80 is connected with an input terminal IN of the drive circuit 30. The gate signal generating circuit 80 generates a pulse wave-form Vc having a predetermined time width from the fall of a check pulse Vi applied to the input terminal IN as shown in FIG. 2.

The AND logical circuit 90 is connected with the gate signal generating circuit 80. The AND logical circuit 90 is capable of performing a logical product operation between the pulse-wave form Vc and the output wave-form Vw from the wave-form shaping circuit 70 and generates a pulse wave-form Vo on its output terminal OU when the solenoid 10 is in a normal state.

Operation of the present embodiment will now be described with reference to FIGS. 2 to 4.

Figure 4:
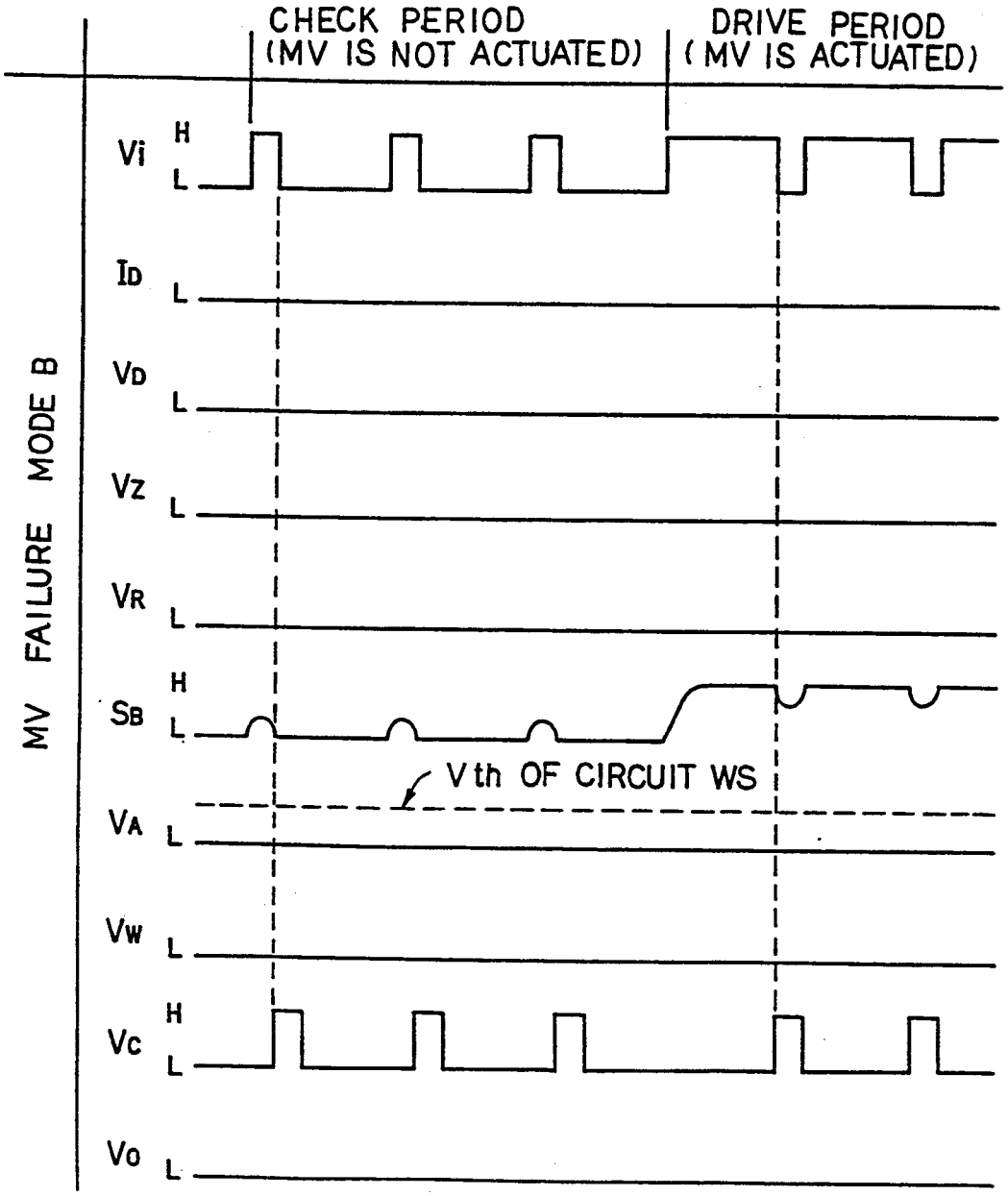
FIG. 4 is a timing chart when a solenoid is in failure mode B.
Figure 5:
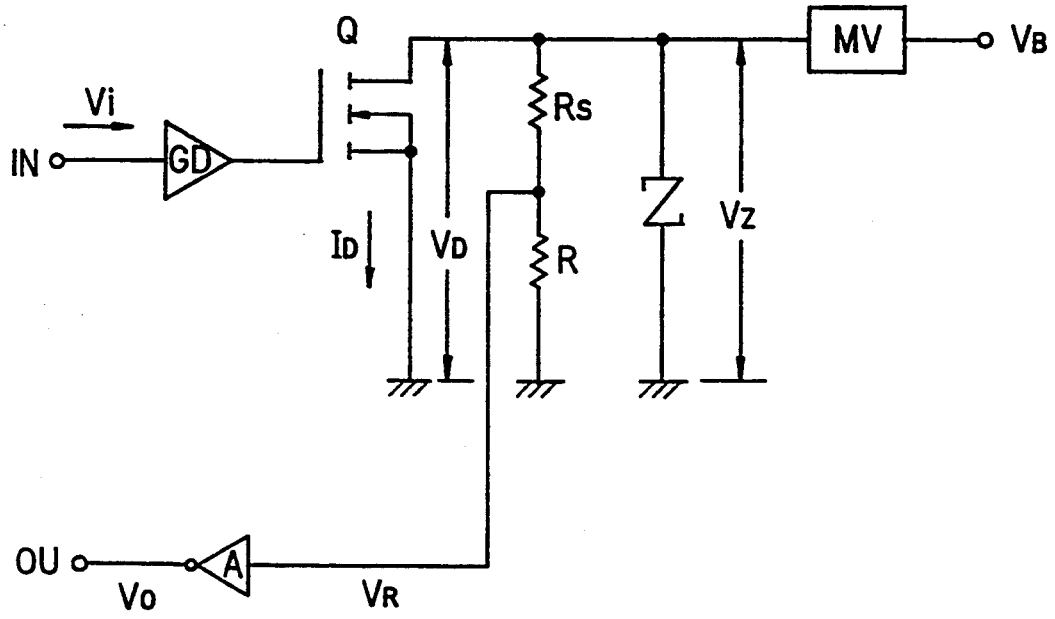
FIG. 5 (PRIOR ART)
FIG. 5 is a schematic block diagram showing a prior art actuator drive apparatus.
Figure 6:
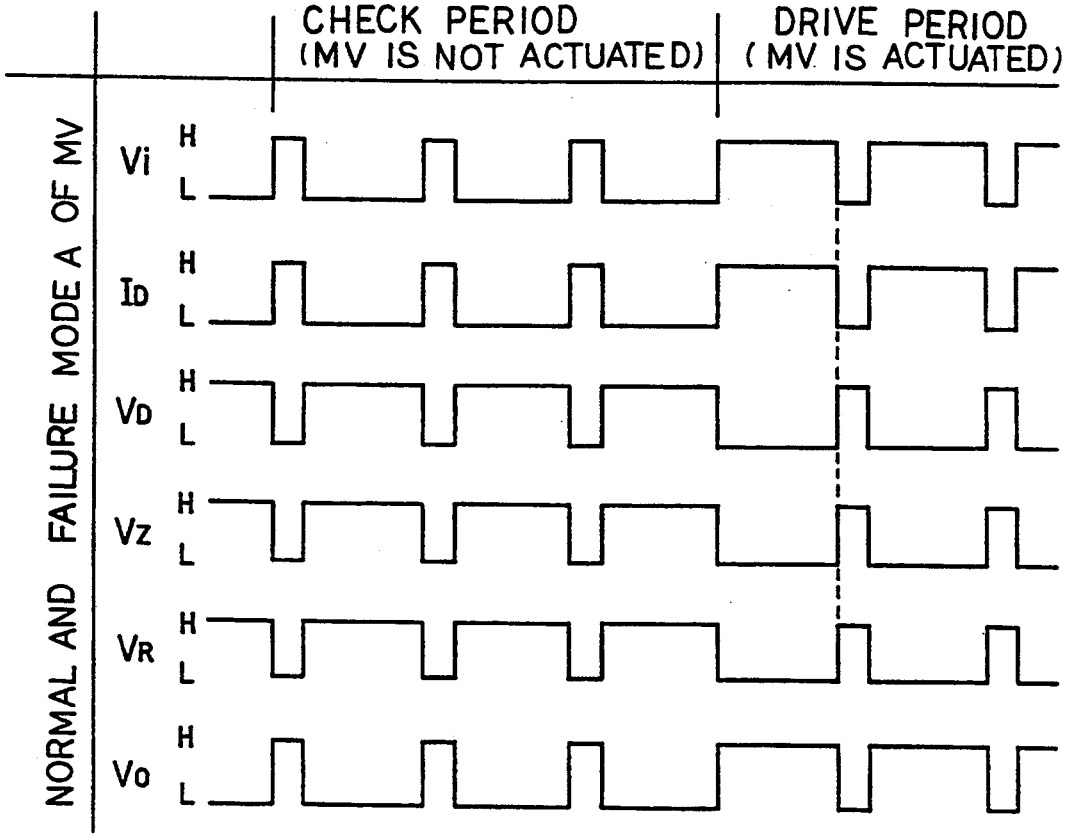
FIG. 6 (PRIOR ART)
FIG. 6 is timing charts when the valve is in a normal mode and a failure mode A.
Figure 7:
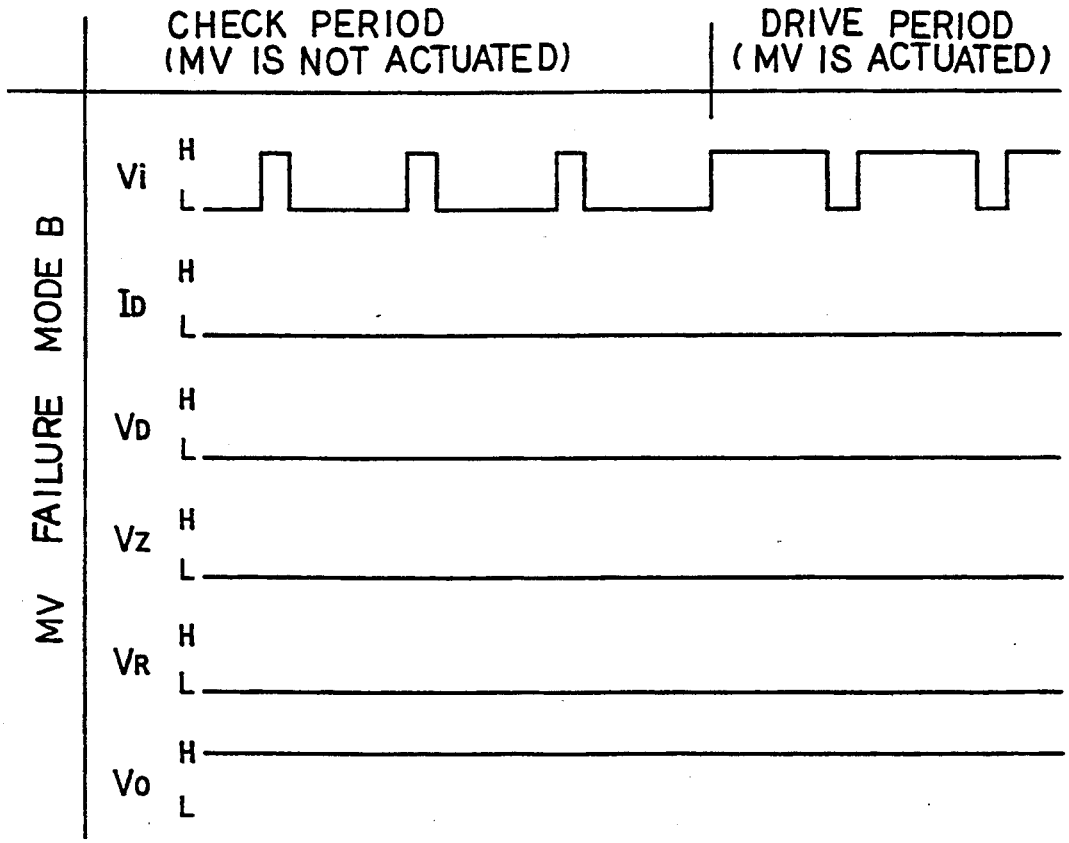
FIG. 7 (PRIOR ART)
FIG. 7 is a timing chart in which the solenoid is in a failure mode B.

Wave-form charts of FIGS. 2 to 4 schematically show waveforms, the peak values and the pulse widths of which are modified for simplicity of illustration.

In a check time period during which the solenoid 10 is not actuated, as shown in FIG. 2, check pulses Vi each having a narrow pulse width are applied to the input terminal IN.

The check pulse Vi has only a drive energy which is considerably lower than the electromagnetic energy which is necessary to actuate the solenoid 10.

Specifically, the check pulse Vi has a pulse width in the order of 1 msec. which is about one tenth of time taken for the solenoid 10 to actuate.

In a drive time period during which the solenoid 10 is actuated, as shown in FIG. 2, check pulses Vi are periodically applied to the input terminal IN at intervals each having duration such that the solenoid 10 does not release.

When a check pulse Vi is applied to the input terminal IN during a check time period when the solenoid 10 is not actuated, the check pulse Vi drives the electronic switch 20 via the drive circuit 30. When the electronic switch 20 is in a conductive state, most of the voltage VB of the power source is applied to the solenoid 10.

The solenoid 10 is energized during a time period when the check pulse Vi is applied to the input terminal IN.

The electromagnetic energy stored in the solenoid 10 is discharged as a counter electromotive force at the moment when the check pulse Vi falls so that the solenoid 10 is turned off.

The induced counter electromotive force is discharged via the series circuit of the surge absorber 40 and the current detecting resistor 50. This protects the electronic switch 20 which is connected in parallel with the surge absorber 40.

Discharge of the counter electromotive force generates a pulse voltage VR across the current detecting resistor 50. Since the resistance of the current detecting resistor 50 is selected to a value which is so low that the characteristics of the surge absorber 40 are not deteriorated, the pulse voltage VR is relatively low.

The pulse voltage VR is applied to a variable gain amplifier 60 so that unnecessary noise is eliminated due to the action of the smoothing circuit 65 and the output wave-form VA is generated from the variable gain amplifier 60.

Since an output wave-form VA is higher than the threshold value Vth of the wave-form shaping circuit 70, an output waveform VA is generated from the wave-form shaping circuit 70.

The output wave-form Vw is applied to the AND logical circuit 90 as an input signal.

When the check pulse Vi is applied to the gate signal generating circuit 80, a pulse wave-form Vc having a predetermined width from the trailing edge of the check pulse Vi is generated from the gate signal generating circuit 80.

The pulse Vc is applied to the AND logical circuit 90 as the other input signal.

When the output wave-form Vw and the pulse Vc are simultaneously applied to the AND logical circuit 90, a pulse wave-form Vo is generated from the AND logical circuit 90. This makes it possible to check whether operation of the drive apparatus and the solenoid 10 is normal before the actuation of the solenoid 10.

A turning on signal is applied to the input terminal IN for the drive period while the solenoid 10 is actuated.

The check pulses Vi are applied to the electronic switch 20 at intervals each having a duration within which the solenoid 10 does not release so that the electronic switch 20 repeats momentary turning off in response to the wave-form of the check pulse Vi.

When the electronic switch 20 is momentarily turned off, the electromagnetic energy stored in the solenoid 10 is discharged via the surge absorber 40 and the current detecting resistor 50, but only during the time the electronic switch 20 remains off.

Since the solenoid 10 is in an operating state, the stored electromagnetic energy is high and the current flowing through the surge absorber 40 and the current detecting resistor 50 is thus high and is approximately equal to the drive current for the solenoid 10.

Accordingly, the voltage generated across the current detecting resistor 50 is also high.

A control voltage having a wave-form SB is generated through the smoothing circuit 65 during the time period when the solenoid 10 is actuated, and is applied as a biasing voltage for controlling the gain of the variable gain amplifier 60. This will decrease the gain of the variable gain amplifier 60.

Similarly to the state in which the solenoid 10 is not actuated, the output wave-form Vw is applied to the logical product circuit 90 via the wave-form shaping circuit 70 and the pulse Vc is applied to the AND logical circuit 90 via the gate signal generating circuit 80 so that pulses Vo are generated from the AND logical circuit 90. It can be determined from the pulses Vo that the operation of the present drive apparatus and the solenoid 10 is normal.

With reference to FIG. 3, a case in which (failure mode A) the solenoid 10 is defective due to a partly-broken or burnt condition of the solenoid will be described.

When a check pulse Vi is applied to the drive circuit 30 while the solenoid 10 is not actuated, no output wave-form Vw is generated from the wave-form shaping circuit 70 between the output wave-form VA from the variable gain amplifier 60 is lower than the threshold value Vth of the waveform shaping circuit 70.

Even if the pulse Vc is input to the AND logical circuit 90 from the gate signal generating circuit 80, no pulse Vo is generated from the AND logical circuit 90. It can be determined from this that the solenoid 10 is in an abnormal condition.

If the turning-on signal is turned off as the check pulse Vi when the solenoid valve 10 is actuated, no output Vw is generated from the wave-form shaping circuit 70 between the output VA generated from the variable gain amplifier 60 is lower than the threshold value Vth of the wave-form shaping circuit 70 similarly to the above-mentioned case in which the solenoid 10 is not actuated. Accordingly, no pulse Vo is generated from the AND logical circuit 90. It can be determined from this that the solenoid 10 is in an abnormal condition.

Since there is little electromagnetic induction in the failure mode A, the pulse voltage VR is low. The foregoing operation is performed.

A case in which the coil of the solenoid 10 is completely broken (failure mode B) will be described with reference to FIG. 4.

Even if the check pulse Vi is applied to the drive circuit 30 when the solenoid 10 is not actuated, no pulse voltage VR is generated. Accordingly, no output wave-form VA is generated from the variable gain amplifier 60 and no output wave-form Vw is generated from the wave-form shaping circuit 70.

Since no output wave-form Vw is generated from the wave-form shaping circuit 70, no pulse Vo is generated from the AND logical circuit 90 even if a pulse Vc is applied to the AND logical circuit 90 from the gate signal generating circuit 80. It can be determined from this that the solenoid 10 is in an abnormal state. If a turning-on signal is turned off as the check pulse Vi, during the actuation time period when the solenoid 10 is actuated, no output wave-form VA is generated from the variable gain amplifier 60 and no output wave-form Vw is generated from the wave-form shaping circuit 70. As a result of the above operations, no pulse Vo is generated from the AND logical circuit 90. Then it can be determined that the solenoid 10 is in an abnormal state.

If the solenoid 10 is brought into a continuously actuated state independently of the input signal due to abnormal operation of the drive circuit 30 or the electronic switch 20, no pulse Vo is generated from the AND logical circuit 90 even if a pulse Vc is input to the AND logical circuit 90 from the gate signal generating circuit 80 since the output wave-form Vw from the wave-form shaping circuit 70 is not input to the AND logical circuit 90. It can be determined from this that the solenoid 10 is in an abnormal state, and such a dangerous conditions can be avoided.

Since the abnormality of the present drive apparatus can be detected in both sates in which the solenoid 10 is actuated and not actuated, the present apparatus can be effectively used in a system requiring a high safety.

Although an circuit which is capable of monitoring an actuator driving apparatus is described in the above-mentioned embodiment, the present invention is not limited to this circuit. For example, pulse signals from a plurality of actuator drive apparatus may be input to a check circuit having a logical AND operation capability so that the plurality of actuator drive apparatuses can be monitored and simultaneously checked.

Although an embodiment has been described in which the pulse Vo is generated form the AND logical circuit 90 when the output wave-forms Vw and Vc are input to the logical product circuit 90 from the wave-form shaping circuit 70 and the gate signal generating circuit 80, respectively. The present invention is not limited to this embodiment. For example, the output Vw and an output from the other solenoid may be input to an AND logic circuit without using the pulse Vc generated form the gate signal generating circuit 80.

In accordance with a drive apparatus for an actuator of the present invention, determination as to whether or not the electromangetic solenoid is defective can be made by using a counter electromotive force due to the electromagnetics generated on interruption of a current through the electromagnetic solenoid. Therefore, abnormalities of the electromagnetic solenoid, etc. can be precisely detected so that the safety can be enhanced.

What is claimed is:

1. A solenoid driver having an electronic switch connected to a solenoid, the driver comprising:

a surge absorber which is connected with a connection between said solenoid and said electronic switch;

a resistive element which is connected between said surge absorber and ground;

an amplifier for amplifying the voltage generated across said resistive element and having a gain which is changed in response to an input signal to said electronic switch;

a gate circuit generating a pulse signal having a predetermined pulse width from the fall of the input signal applied to said electronic switch; and an AND logical circuit for comparing the pulse signal from said gate circuit with the output signal from said amplifier.

2. A solenoid driver having an electronic switch connected to a solenoid, the driver comprising:

a surge absorber which is connected with a connection between said solenoid and said electronic switch;

a resistive element which is connected between said surge absorber and ground wherein excess voltage not absorbed by said surge absorber flows through said resistive element;

an amplifier for amplifying the voltage generated across said resistive element and a check for checking the output signal from said amplifier.

3. A solenoid driver having an electronic switch connected to a solenoid, the driver comprising:

a surge absorber which is connected with a connection between said solenoid and said electronic switch;

a resistive element which is connected between said surge absorber and ground wherein excess voltage not absorbed by said surge absorber flows through said resistive element; and a check circuit for checking a voltage signal generated across said resistive element.

* * * * *

UNITED STATES PATENT AND TRADEMARK OFFICE

CERTIFICATE OF CORRECTION

PATENT NO. : 5,404,262
DATED : April 4, 1995
INVENTOR(S) : Takashi Enomoto and Takashi Kunimi It is certified that error appears in the above-identified patent and that said Letters Patent is hereby corrected as shown below:

Title page,
Item [73], Assignees, should read:
-- Nihon Inter Electronics Corporation, Kanagawa, Japan;
Akebeno Brake Industry Co., Ltd, Tokyo, Japan --

Signed and Sealed this

Twenty-fifth Day of February, 2003

JAMES E. ROGAN
*Director of the United States Patent and Trademark Office*